US006102811A

United States Patent [19]

Henry

[11] Patent Number: 6,102,811

[45] Date of Patent: Aug. 15, 2000

[54] CRESTED LIE BOARD

[75] Inventor: Randy Henry, Hayden Lake, Id.

[73] Assignee: Henry-Griffitts, Inc., Hayden Lake, Id.

[21] Appl. No.: 09/304,116

[22] Filed: May 3, 1999

[51] Int. Cl.[7] ..... A63B 69/36

[52] U.S. Cl. ..... 473/257; 473/407

[58] Field of Search ..... 473/219, 257, 473/261, 407

[56] References Cited

U.S. PATENT DOCUMENTS

| | | | |
|---|---|---|---|
| 2,866,645 | 12/1958 | Cayot | 473/261 X |
| 3,427,031 | 2/1969 | Scott | 473/261 X |
| 3,784,208 | 1/1974 | Weygandt | 473/257 |
| 5,421,579 | 6/1995 | Uebele | 473/257 X |
| 5,803,826 | 9/1998 | Perrine | 473/257 X |
| 5,984,802 | 11/1999 | Perrine | 473/257 X |

*Primary Examiner*—John A. Ricci
*Attorney, Agent, or Firm*—John S. Reid

[57] ABSTRACT

A lie board used for fitting golf clubs to golfers having a crested portion. In one embodiment the upper surface of the lie board is curved convexly with respect to the lower surface of the lie board. The crested portion can include the entire lie board, or only the portion where contact between the sole of the club and the board is anticipated. The crested portion can have curvature in only a single direction, or it can be curved in orthogonal directions to produce an essentially dome-shaped lie board. When only a single direction of curvature is used, the curvature is preferably in the intended general direction of the travel of the club head across the lie board.

12 Claims, 7 Drawing Sheets

5
7
4
10
6
12

CRESTED LIE BOARD

FIELD OF THE INVENTION

This invention pertains to lie boards for use in fitting golf clubs to golfers.

BACKGROUND

A lie board is a device used to determine whether a particular configuration of a golf club fits a particular end user. Among the several variables that can be adjusted in fitting a golf club or a set of clubs to a particular user are the length of the shaft attached to the head of the club, as well as the angle at which the hosel and/or shaft is attached to the club head. In determining whether a particular combination fits the user, the user swings a club configuration (shaft and club head) at a real or imagined golf ball on a device known as a lie board. The "golf ball" is identified by a mark on the lie board indicating where the center of the ball lies. Prior art lie boards are typically flat, rectangular sheets of plastic.

When the sole of the club head contacts the lie board during the swing, a mark is made indicating the point of contact between the lie board and the golf club head. This mark can either be made on the lie board itself, or on the sole of the golf club. Various methods are used to make the mark. In one method, a strip of tape is adhered to the sole of the club head. Abrasion between the lie board and the club head marks the tape, indicating the point of contact. In another method, the tape can leave a mark on the lie board. Yet another method uses an abradable surface attached to the lie board itself, which is abraded by the golf club head during contact. In a similar manner, a tape or strip which leaves a mark (similar to carbon paper) can be attached to either the lie board or the club head, thus leaving a mark on the sole of the club head or the lie board, respectively.

Since the location of the mark indicates what, if any, adjustments are necessary to the club/shaft combination for the particular user, it is important that the mark be rather precise, and not cover a large area. It is thus desirable to have a lie board which produces such a precise mark when fitting a golfer to a golf club or a set of golf clubs.

SUMMARY

A lie board having a crested portion is disclosed. The crest is convex with respect to the surface on which the lie board rests. The crested portion can include the entire lie board, or only the portion where contact between the sole of the club and the board is anticipated. The crested portion can have curvature in only a single direction, or can be curved in orthogonal directions to produce an essentially dome-shaped lie board. When only a single direction of curvature is used, the curvature is preferably in the intended general direction of the travel of the club head across the lie board.

BRIEF DESCRIPTION OF THE DRAWINGS

FIG. 13 is a side elevation view of an alternate embodiment of a lie board constructed in accordance with the present invention.

DETAILED DESCRIPTION OF THE PREFERRED EMBODIMENTS OF THE INVENTION

When the sole of a golf club head contacts a lie board during a practice swing of a golf club, a mark is made indicating the point of contact between the lie board and the golf club head. This mark can either be made on the lie board itself, or on the sole of the golf club. Various known methods are used to make the mark. In one method, a strip of tape is adhered to the sole of the club head. Abrasion between the lie board and the club head marks the tape, indicating the point of contact. When a golf club is correctly fitted to a user, and the user swings the club correctly, the sole of the club head should contact the ground at a particular point, both as measured on the sole of the club head and on the ground. By measuring the difference between the actual point of contact, and the ideal point of contact, it is possible to determine the reason that the club head did not make contact at the ideal points. A lie board makes such measurements possible. Using this information, adjustments can be made to the golf club (i.e., the golf club is "fitted" to the user), to improve the golfer's accuracy. It is therefore important that the difference between the location of the ideal point of contact, and the actual point of contact, be capable of accurate measurement. If the actual point of contact is indicated by a relatively large mark, the ability of an individual to make accurate measurements is decreased. It is therefore desirable to provide a method and apparatus capable of producing a more accurate lie mark using a lie board. The invention disclosed here produces such advantageous results.

The invention includes a lie board having a crested portion. The upper surface is preferably curved such that it forms a crest which is convex with respect to the lower surface of the lie board which rests on the ground. The crested portion can include the entire lie board, or only a portion of the lie board where contact between the sole of the club and the lie board is anticipated. The crested portion can have curvature in only a single direction, or it can be curved in orthogonal directions to produce a dome-shaped lie board. When only a single direction of curvature is used, the curvature is in the general intended direction of the travel of a golf club head across the upper surface of the lie board.

Figure 1:
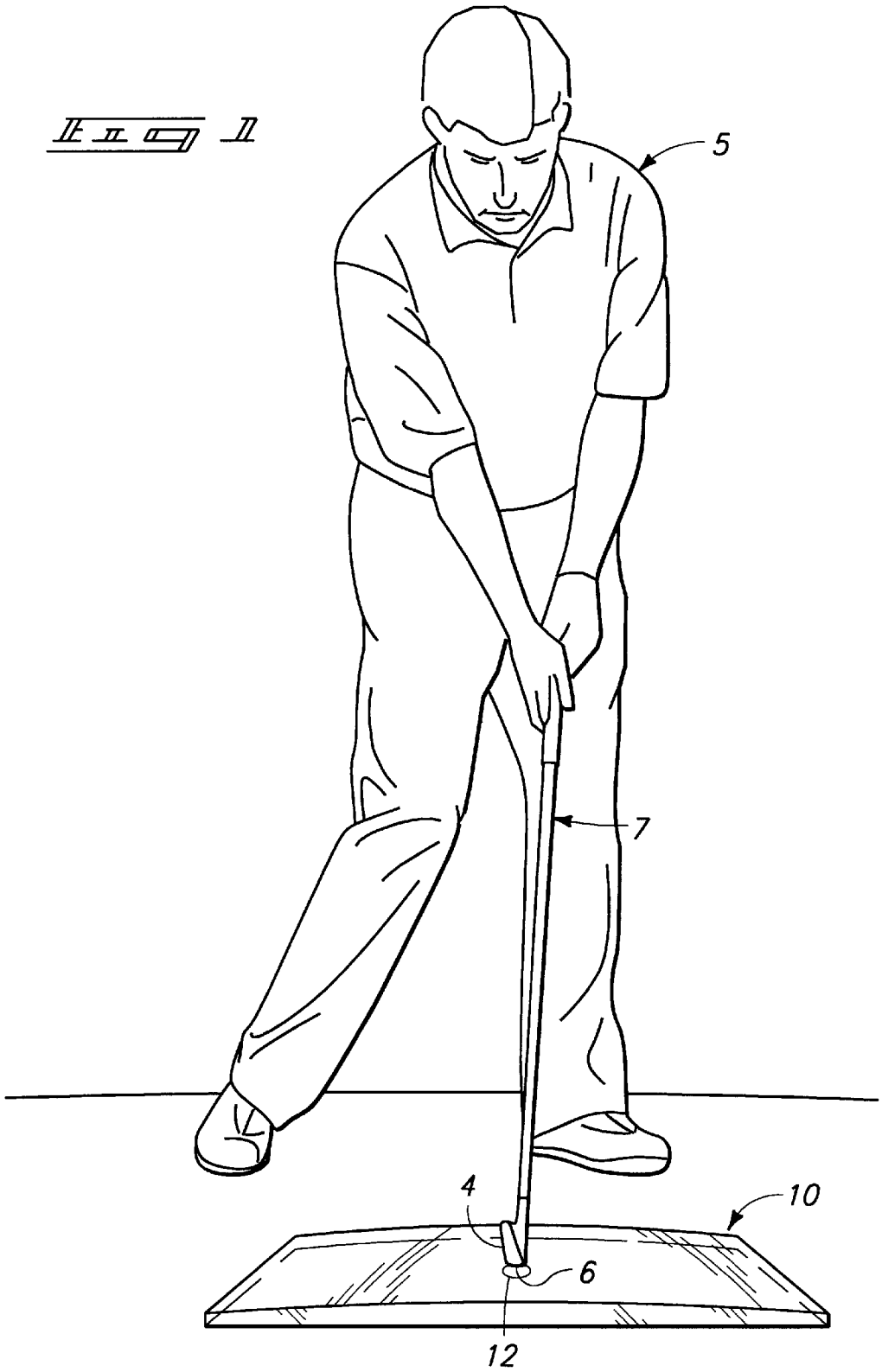
FIG. 1 is an environmental view showing a lie board in accordance with the present invention in use.
Figure 2:
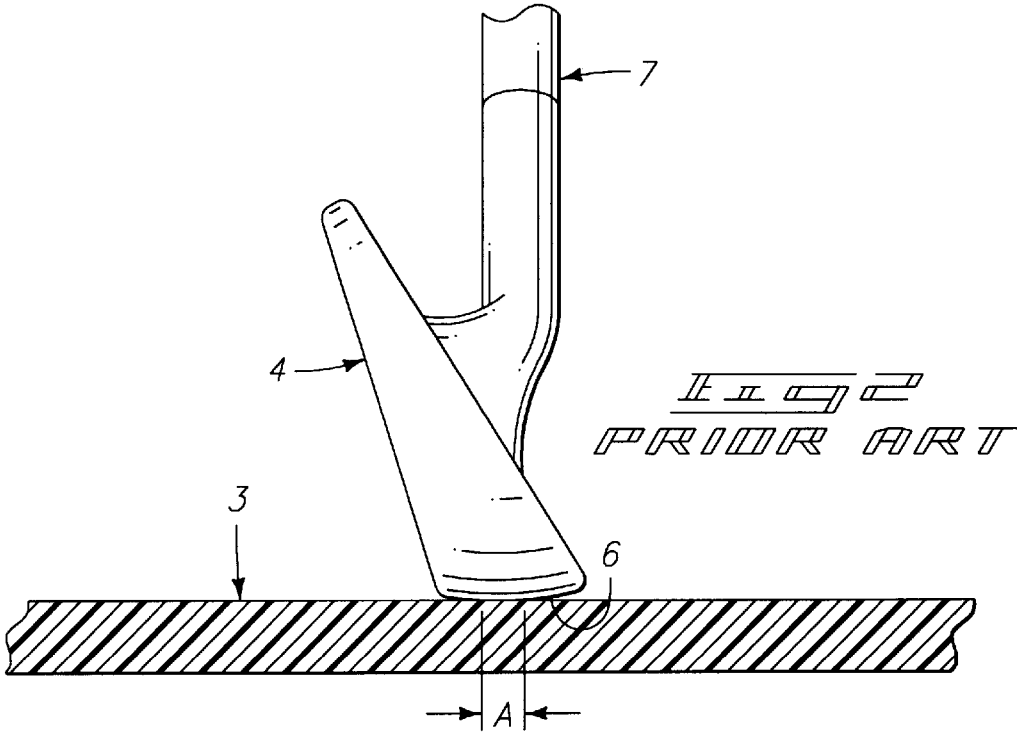
Fig 2 PRIOR ART
FIG. 2 is a detail side view showing how a golf club head can contact a prior art lie board.
Figure 3:
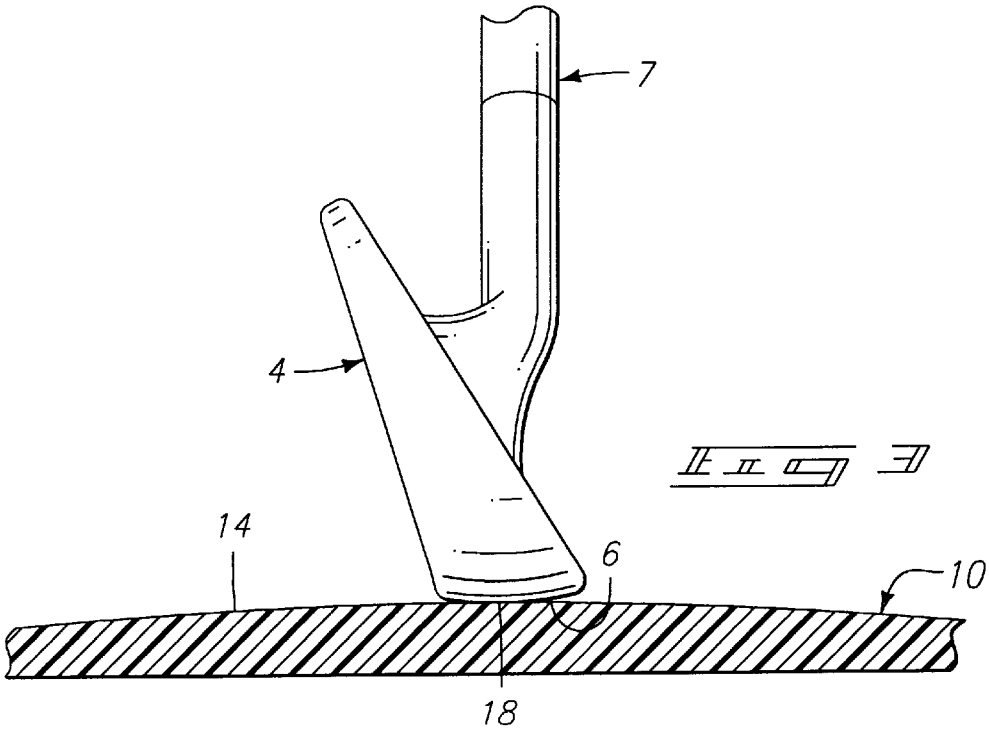
FIG. 3 is a detail side view of FIG. 1 showing how a golf club head can contact a lie board constructed in accordance with the present invention.

Turning to FIG. 1, an environmental view showing how a lie board constructed in accordance with the present invention is used. A golfer 5 swings a golf club 7 at a mark 12 on the lie board 10. The mark 12 indicates the theoretical position of a golf ball at which the golfer swings. As the golfer swings the club 7, the sole 6 of the head 4 of the club should contact the lie board. This contact will cause a mark to be made on either the lie board or on the sole of the golf club head, as described more fully below. Turning to FIG. 3, a detail of the club head 4 as it contacts the lie board 10 is shown. As can be seen, the sole makes essentially point contact at point 18 on the upper surface 14 of the lie board 10. This should be compared with the prior art lie board shown in FIG. 2. As can be seen in FIG. 2, the sole 6 of the club head 4 contacts the prior art lie board 3 across the entire area "A".

Figure 4:
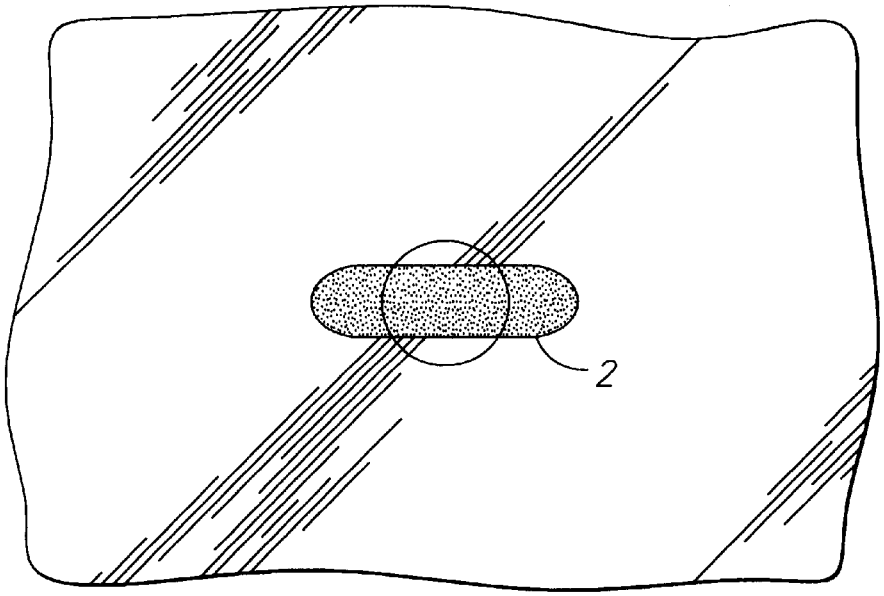
FIG 4 PRIOR ART
FIG. 4 is a plan view of a lie mark made on a prior art lie board.
Figure 5:
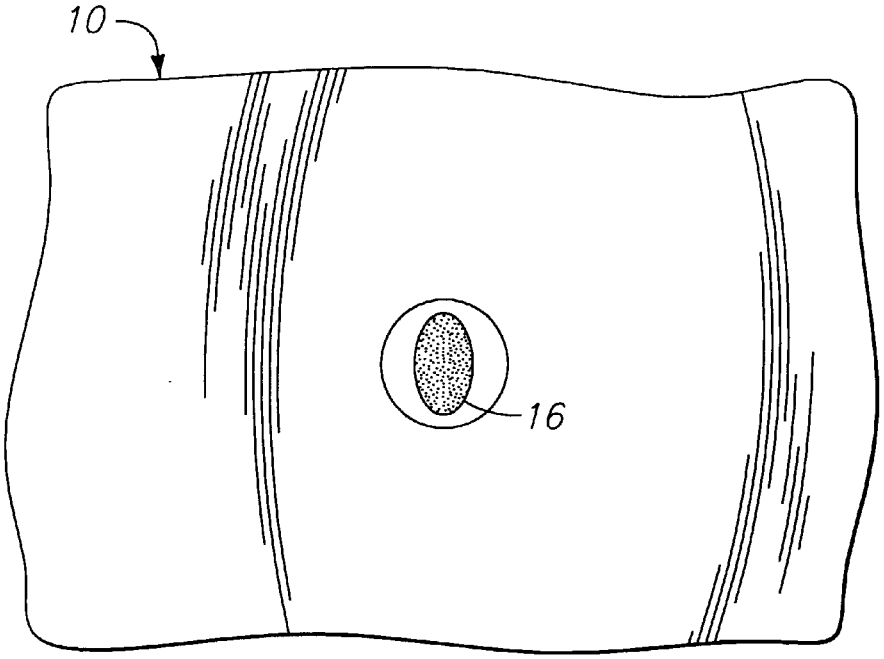
FIG. 5 is a plan view of a lie mark made on a lie board constructed in accordance with the present invention.

Turning to FIG. 4, a mark 2 made on a prior art lie board is shown. This should be compared with the mark 16 made on a lie board 10 constructed in accordance with the present invention, as shown in FIG. 5. The mark 16 made on the lie board 10 of the present invention is much smaller than the mark 2 made on the prior art lie board of FIG. 4. Consequently, the lie board of the present invention gives a much more precise indication of the point of contact of the club head and the lie board. This allows the golf club to be more accurately fitted to the user, since much more accurate measurements can be made between the intended point of contact and the actual point of contact, as indicated by the mark. Exemplary embodiments of the present invention will now be described in detail.

Figure 6:
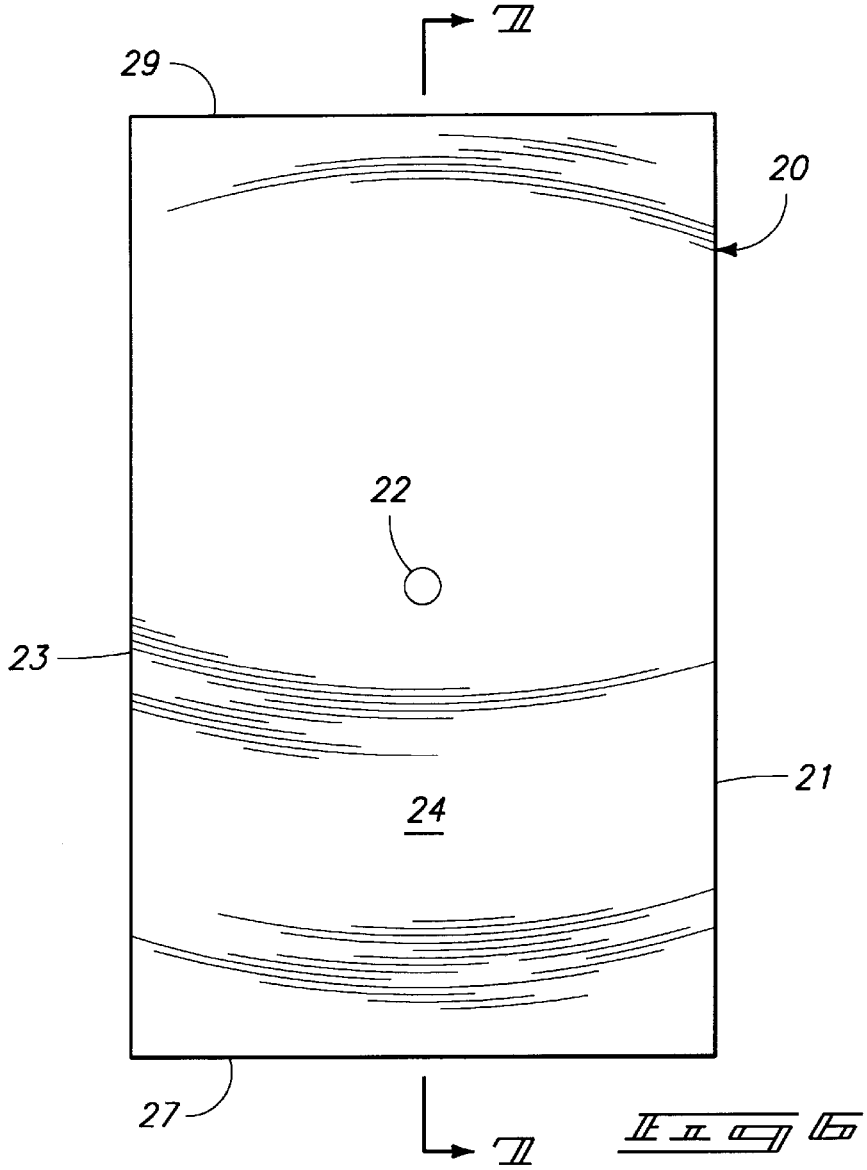
FIG. 6 is a plan view of a first embodiment of a lie board in accordance with the present invention.
Figure 7:
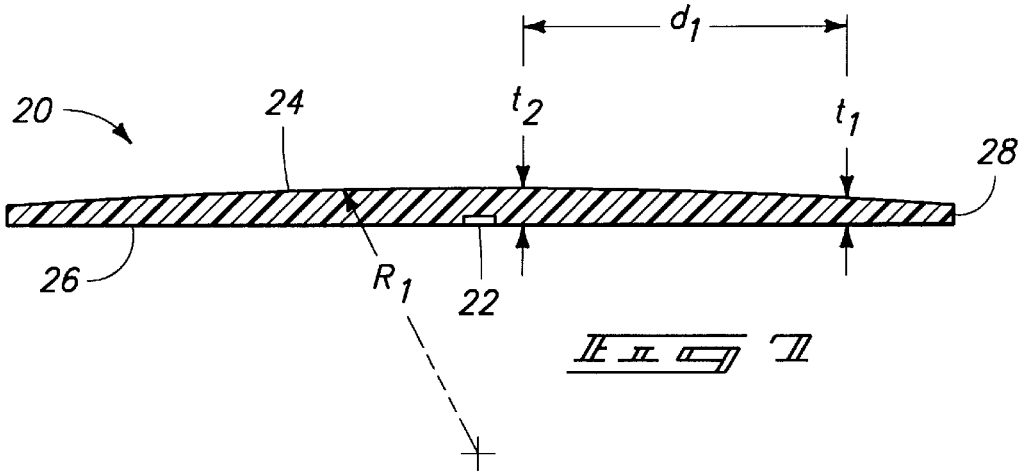
FIG. 7 is a side sectional elevation view of the lie board of FIG. 6.

Referring to FIG. 6, a first embodiment of a lie board 20 in accordance with the present invention is shown. The lie board 20 is rectangular in plan view, as shown. Towards the center of the lie board is a mark or target 22, which indicates the theoretical position of a golf ball. This corresponds to the target at which a golfer swings with a golf club in order to check the golf club for fit, or the golfer for correct position, using the lie board. The intended direction of travel of a golf club head across the lie board 20 is from lower edge 27 to upper edge 29. A cross section of the lie board 20 along the direction of swing is shown in FIG. 7. The lie board 20 has a lower surface 26, which is intended to rest on the ground, and an upper surface 24. The lie board 20 is bounded by periphery 28. As can be seen, the upper surface 24 is shaped convexly with respect to the lower surface 26 of the lie board 20. This results in the lie board 20 growing incrementally thicker from the periphery 28 to the center of the lie board at target 22. Preferably, the thickest portion of the lie board corresponds with the position of the target 22.

The "thickness" of the lie board 20 is indicated in FIG. 7 by the exemplary measurements $t_1$ towards the periphery 28 of the lie board 20, and $t_2$ towards the center of the lie board, as indicated by target 22. Preferably, the increase in thickness in the lie board from the thinnest part to the thickest part is not linear with respect to distance from the periphery 28. More preferably, the increase in thickness is non-linear, resulting in a upper surface 24 being curved with respect to the lower surface 26. More preferably, at least a portion of the upper surface 24 is convex with respect to the lower surface 26. This results in the lie board having a crested portion. The curvature can be according to an arcuate function. The arcuate function can for example be according to the formula for a circle, so that the upper surface 24 forms an arc of a circle having radius $R_1$. In another example, the curvature of the upper surface 24 can be according to a formula for a parabola. Other precise formulas can also be employed to describe the curvature of the upper surface with respect to the lower surface, as for example a catenary formula or an elliptical formula. Further, the curvature of the upper surface 24 does not need to be capable of description by known mathematical formulae, and can be according to a free form resulting in the upper surface having a portion which is crested with respect to the lower surface.

When the lie board is curved in only a single direction along the intended direction of travel of a golf club head across the upper surface, as shown in FIG. 7, the sole of a golf club head will strike the upper surface at a point on a line which extends from side to side 23 of the lie board, as shown in FIG. 6.

Figure 8:
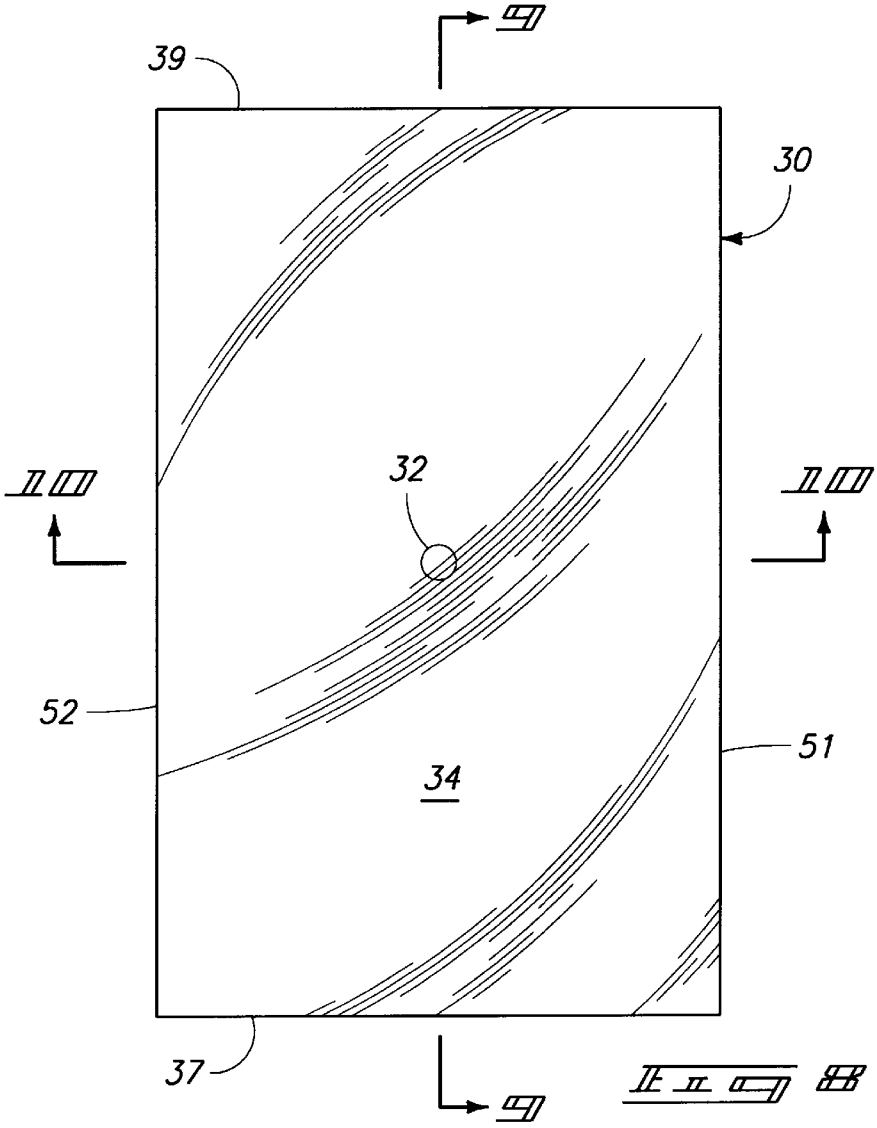
FIG. 8 is a plan view of a second embodiment of a lie board in accordance with the present invention.
Figure 9:
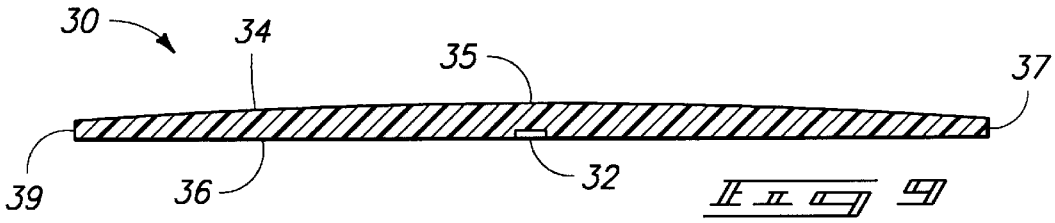
FIG. 9 is a side sectional elevation of the lie board of FIG. 8.
Figure 10:
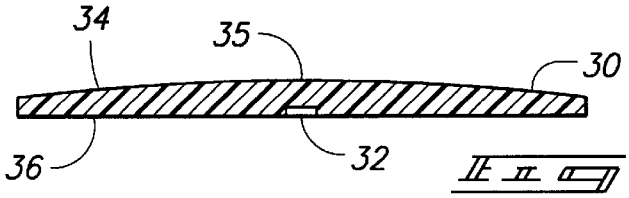
FIG. 10 is a front sectional elevation view of the lie board of FIG. 8.

Turning to FIGS. 8–10, a second embodiment of a lie board 30 in accordance with the present invention is shown. The lie board 30 is rectangular in shape in plan view, as shown in FIG. 8. The target at which a golfer swings a golf club is indicated by 32, and the intended direction of travel of the golf club head across the upper surface 34 of the lie board 30 is from lower edge 37 to upper edge 39. Turning to FIG. 9, a cross section of the lie board 30 of FIG. 8 is shown. The cross section shown in FIG. 9 is along the intended direction of travel of a golf club across the upper surface 34, and resembles that of the lie board 20 shown in FIGS. 6 and 7. The upper surface of lie board 30 is curved from edge 37 to edge 39, resulting in the upper surface being shaped convexly in a first direction with respect to the lower surface 36. In this first direction of curvature, the upper surface 34 is highest with respect to the lower surface 36 at point 35, which corresponds with the location of the target 32.

Turning now to FIG. 10, a cross section of the lie board of FIG. 8 orthogonal to the cross section shown in FIG. 9 is depicted. It can be seen that the lie board 30 is further curved from front edge 52 to back edge 51. This curvature is orthogonal to the intended direction of travel of a golf club head across the upper surface 34. The upper surface 34 of the lie board 30 is thus shaped convexly in a second direction with respect to the lower surface 36. In the second direction of curvature, the upper surface 34 is highest with respect to the lower surface 36 at point 35, which corresponds with the location of the target 32. The second direction of curvature, in combination with the first direction of curvature discussed above, results in the upper surface 24 having two-dimensional curvature in space. Accordingly, each point on the upper surface will ideally have a unique line of tangency associated with it. This means that the sole of a golf club striking the surface will essentially make point contact with the upper surface of the lie board, leaving a very precise lie mark on either the lie board or the sole of the golf club.

In a similar manner as was described for the lie board 20 of FIGS. 6 and 7, the curvatures of lie board 30 of FIGS. 8–10 can take a variety of shapes. If the curvature in both directions is on a constant radius, then the upper surface 34 of lie board 30 comprises a spherical surface segment. Further, there is no requirement that the curvature be according to the same formula in both directions. For example, the lie board 30 can be curved parabolically in the first direction, and circularly in the second direction.

Figure 11:
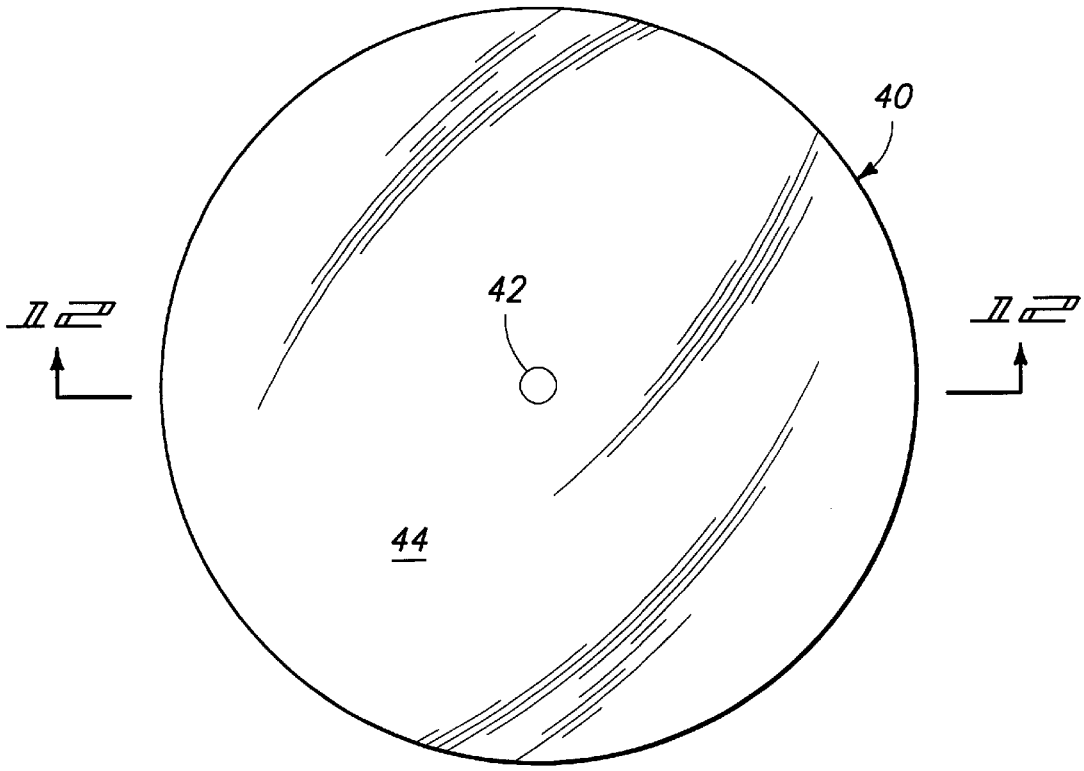
FIG. 11 is a plan view of a third embodiment of a lie board in accordance with the present invention.
Figure 12:
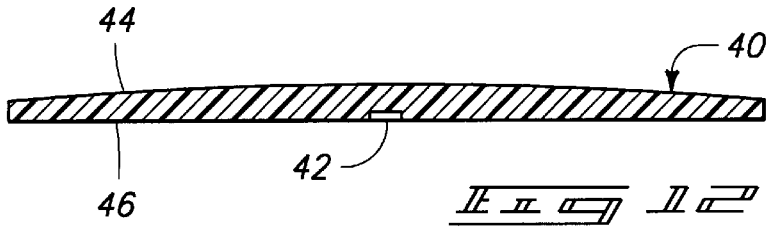
FIG. 12 is a side sectional elevation view of the lie board of FIG. 11.
Figure 11:
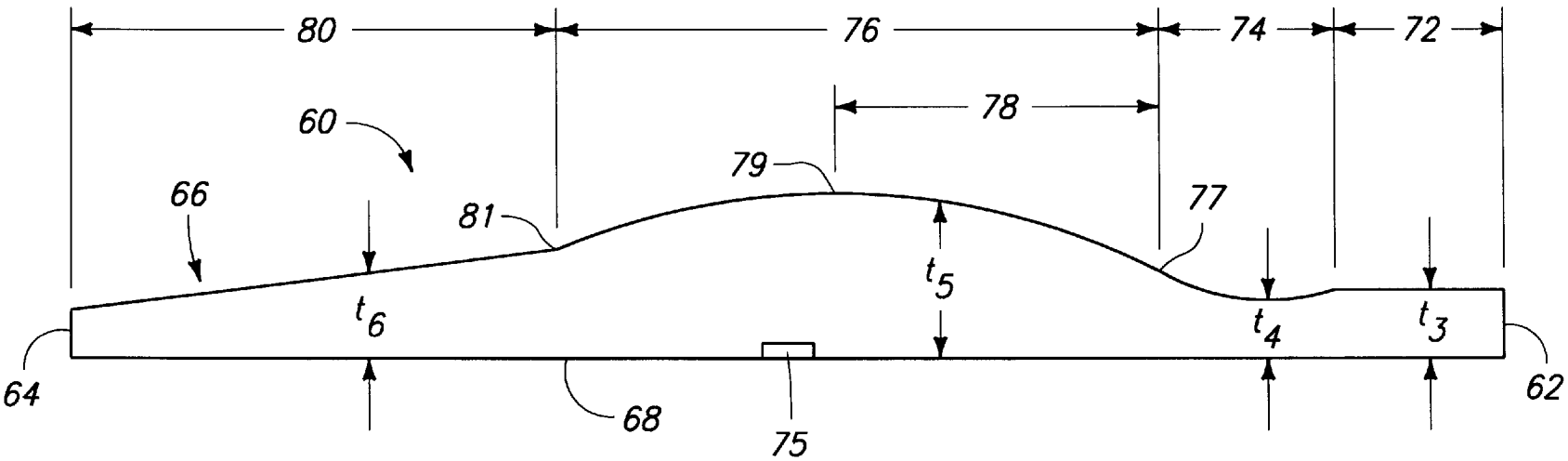

Referring now to FIGS. 11 and 12, a third embodiment of a lie board in accordance with the present invention is shown. In the plan view shown in FIG. 11, the lie board 40 is essentially circular in shape. The lie board 40 has a target 42 located at approximately the center of the lie board. Turning to FIG. 12, one cross section of the lie board 40 of FIG. 11 is shown. The upper surface 44 is curved convexly with respect to the lower surface 46. In the example shown, the curvature follows a constant radius. This cross section is exemplary, and the lie board 40 has the same cross sectional profile as that shown in FIG. 12 across any cross section passing through target 42. Accordingly, the upper surface 44 of the lie board 40 comprises a segment of the surface of a sphere. Such allows for simplicity when placing the lie board for use, since there is no preferred orientation of the upper surface with respect to the golfer, other than that it should be facing upward.

The lie boards in accordance with the present invention shown in FIGS. 6–12 show the upper surface of the lie board as being curved with respect to the lower surface in a continuous manner over the entire upper surface. However, there is no requirement that the entire upper surface be curved, or that it be curved symmetrically from one edge of the lie board to the other. The lie board only need have a portion of the upper surface which is curved with respect to the lower surface, providing a crested portion. Preferably, the crested portion lies in the region most likely to be contacted by the sole of the golf club during a practice swing of the club. For example, turning to FIG. 13, a side view of a lie board 60 in accordance with the present invention is shown. The lie board 60 has an upper surface 66 and a lower surface 68 which is intended to rest on the ground. The lie board 60 is intended to be positioned such that a golfer swings a club from the right edge 62 to the left edge 64 of the lie board 60.

The upper surface 66 of lie board 60 is segmented into four distinct regions in the example shown. The various thicknesses of the lie board 60 have been exaggerated to more clearly show the various geometries of the upper surface of the lie board. In the first region 72, the thickness $t_3$ is constant across the region. In the second region 74, the thickness $t_4$ is non-linear across the region, and forms a concave portion with respect to the lower surface 68. In the third region 76, the thickness $t_5$ is non-linear across the region, and forms a portion which is convex with respect to the lower surface 68. The region 76 increases in thickness from point 77 to point 79, which corresponds with the location of the target 75. From point 79 to point 81 the thickness of the lie board decreases. This results in the portion 76 being crested with respect to the lower surface 68. Region 76 is the region most likely to be contacted by the sole of a golf club during a practice swing at the target 75. Finally, the lie board 60 includes region 80, which decreases in thickness linearly from point 81 to the edge 64.

It should be understood that lie board 60 is exemplary only to demonstrate one possible combination of regions which can be included in a lie board in accordance with the present invention. Other configurations producing a crested portion of the upper surface of the lie board with respect to the lower surface can also be employed and still be within the scope of the present invention.

It is understood that a lie board of the present invention can be fabricated from materials traditionally used for lie boards. For example, clear Lucite (E. I. Du Pont Nemours & Co., Inc) having an opaque coating on the bottom surface is often used. Translucent plastics are also used. Typically when a transparent or translucent material is used the target is applied to the bottom surface, as suggested in FIGS. 7, 9 and 12, so that abrasion from the golf club sole striking the lie board does not wear off the target. Opaque materials, typically plastics, can also be used to fabricate lie boards. When an opaque material is used, the target is typically printed on or is formed into the upper surface of the lie board.

In one example, a lie board in accordance with the present invention has a crested portion of the upper surface having a radius of curvature of between about 0.3 meters and 15 meters, as indicated by the dimension "R" of FIG. 7. In another example, in a lie board in accordance with the present invention, the vertical dimension from the lower surface to the uppermost portion of the crested upper surface is at least 0.2 inches greater than the vertical dimension from the lower surface to the upper surface at the edge of the lie board.

While the above invention has been described with particularity to specific embodiments and examples thereof, it is understood that the invention comprises the general novel concepts disclosed by the disclosure provided herein, as well as those specific embodiments and examples.

I claim:

1. A lie board having a crested surface comprising: a thickest portion, and a target which is visible on the crested surface and which substantially coincides with the thickest portion.

2. A lie board having a crested surface, comprising: a lower surface and an upper surface, the upper surface being curved convexly with respect to the lower surface in at least one dimension to form the crested surface.

3. The lie board of claim 2 wherein the lie board comprises a first side edge and a second side edge, and wherein the upper surface is curved convexly with respect to the lower surface between the first side edge and the second side edge.

4. The lie board of claim 3 wherein the lie board further comprises an upper side edge and a lower side edge, and wherein the upper surface is further curved convexly with respect to the lower surface between the upper side edge and the lower side edge.

5. The lie board of claim 2 wherein the lie board is circular in shape.

6. The lie board of claim 2 wherein the upper surface is curved convexly with respect to the lower surface along a fixed radius.

7. The lie board of claim 2 wherein the upper surface is curved convexly with respect to the lower surface along a parabolic path.

8. The lie board of claim 2 wherein the lie board further comprises a marking for representing a theoretical position of a golf ball with respect to the upper surface.

9. The lie board of claim 2 wherein the upper surface has a radius of curvature of between about 0.3 meters and 15 meters.

10. The lie board of claim 2 wherein the lie board is fabricated from a primarily transparent material and further wherein the lower surface comprises an opaque coating.

11. The lie board of claim 2 wherein the lie board has an outer periphery defined by an edge, and wherein the crested upper surface is defined by an uppermost portion, and wherein the dimension from the lower surface to the uppermost portion of the crested upper surface is at least 0.2 inches greater than the dimension from the lower surface to the upper surface at the edge.

12. A lie board having a crested surface, comprising: a lower surface and an upper surface, at least a portion of the upper surface being curved convexly with respect to the lower surface in at least one direction to form the crested surface.

* * * * *